US011650035B2

(12) United States Patent
Forge et al.

(10) Patent No.: US 11,650,035 B2
(45) Date of Patent: May 16, 2023

(54) GYROSTABILIZED PROJECTILE

(71) Applicant: NEXTER MUNITIONS, Versailles (FR)

(72) Inventors: Anthony Forge, Bourges (FR); Sylvain Jayet, Bourges (FR); Nicolas Caillaut, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 0 days.

(21) Appl. No.: 17/539,276

(22) Filed: Dec. 1, 2021

(65) Prior Publication Data

US 2022/0170724 A1 Jun. 2, 2022

(30) Foreign Application Priority Data

Dec. 2, 2020 (FR) ..... 2012455

(51) Int. Cl.
*F42B 12/62* (2006.01)
*F42B 12/64* (2006.01)

(52) U.S. Cl.
CPC ..... *F42B 12/64* (2013.01)

(58) Field of Classification Search
CPC ..... F42B 12/56; F42B 12/58; F42B 12/60; F42B 12/62; F42B 12/625; F42B 12/64
See application file for complete search history.

(56) References Cited

U.S. PATENT DOCUMENTS 2,767,656 A * 10/1956 Zeamer ..... F42B 12/64 102/438
3,954,060 A * 5/1976 Haag ..... F42B 12/64 102/494
3,956,990 A * 5/1976 Rowe ..... F42B 12/64 102/494
3,981,244 A * 9/1976 Adimari ..... F42B 12/62 102/489

(Continued)

FOREIGN PATENT DOCUMENTS

EP 0 152 725 A2 8/1985
EP 2 578 987 A1 4/2013
FR 2 952 424 A1 5/2011

OTHER PUBLICATIONS

Aug. 24, 2021 Search Report and Written Opinion issued in French Patent Application No. 2012455.

*Primary Examiner* — Derrick R Morgan
(74) *Attorney, Agent, or Firm* — Oliff PLC

(57) ABSTRACT

A projectile includes a hollow body carrying a payload formed of inert sub-projectiles that can be dispersed on trajectory contained in a cup including a piston closing one of its ends, the body at its rear part with a base housing a pyrotechnic charge separated from the sub-projectiles by the piston, which can translate with respect to the body of the projectile to push the cup and the sub-projectiles axially out of the body. The cup is formed of independent sectors. The piston is secured to the sectors when contained in the body and the cup is secured to the body by a connecting apparatus (Continued)

weakened to break under the force of the piston pushed by the gases generated by the pyrotechnic charge. An ogive is secured to the cup by a securing apparatus that is coaxial with the longitudinal axis of the projectile and locked by the sectors.

9 Claims, 5 Drawing Sheets

(56) References Cited

U.S. PATENT DOCUMENTS

| | | | | |
|---|---|---|---|---|
| 4,221,167 | A * | 9/1980 | Berlin | F42B 12/58 102/489 |
| 4,294,172 | A * | 10/1981 | Rauschert | F42C 21/00 102/275.9 |
| 4,430,941 | A * | 2/1984 | Raech, Jr. | F42B 12/64 102/494 |
| 4,793,260 | A * | 12/1988 | Kruse | F42B 12/62 102/357 |
| 8,333,153 | B2 * | 12/2012 | Caillat | F42B 14/064 102/522 |
| 10,703,451 | B1 * | 7/2020 | Adams | F41F 3/10 |
| 2005/0066838 | A1 * | 3/2005 | Doughty | F42B 12/62 102/357 |
| 2014/0251173 | A1 * | 9/2014 | Schneider | F42B 12/60 102/489 |
| 2020/0208951 | A1 * | 7/2020 | Allison | F42C 9/10 |
| 2020/0300591 | A1 * | 9/2020 | Painter, III | F42B 12/60 |
| 2020/0348115 | A1 * | 11/2020 | Garst | F42B 10/16 |
| 2020/0363176 | A1 * | 11/2020 | Pigott | F41G 1/46 |

* cited by examiner

[Fig. 1]
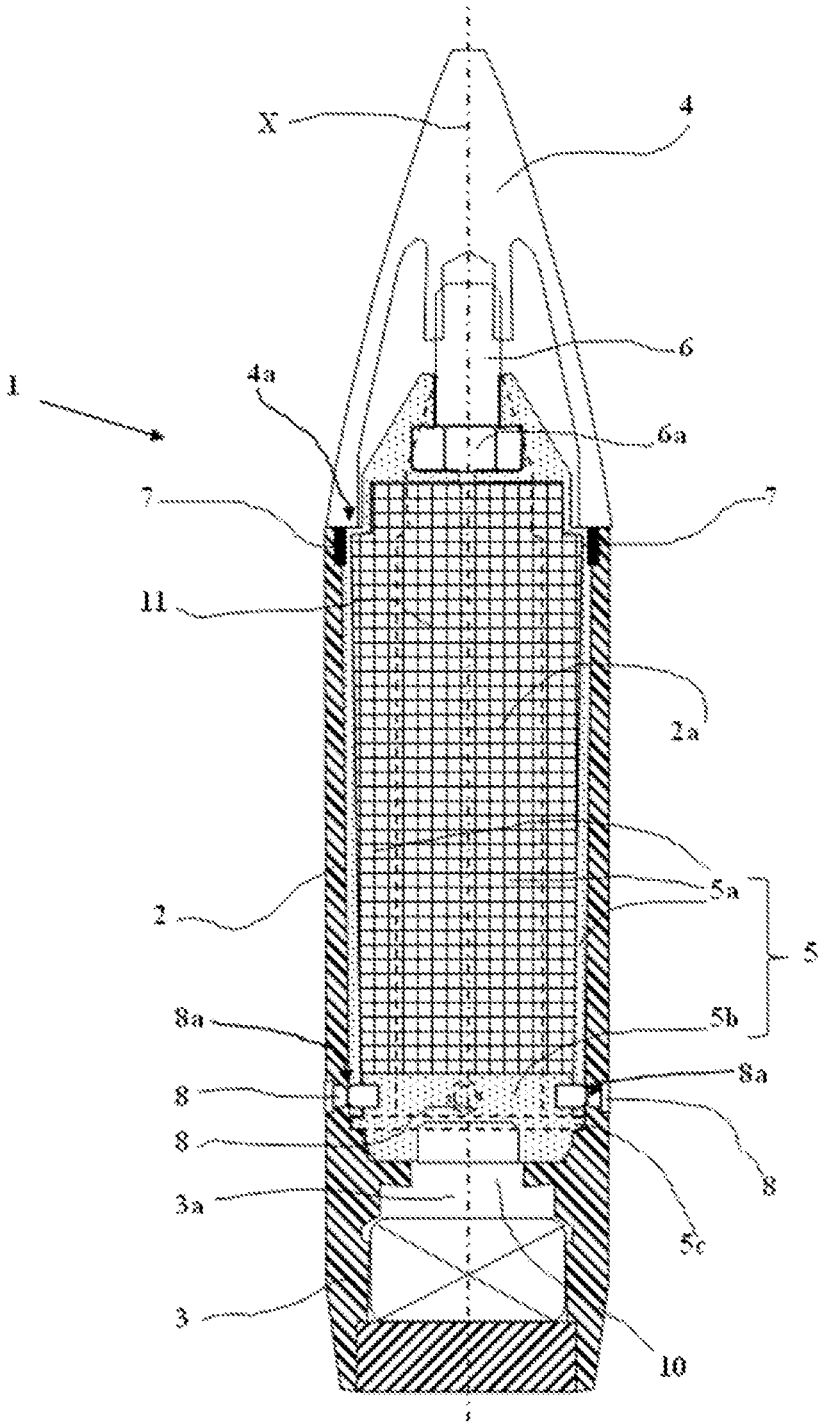

[Fig. 2]
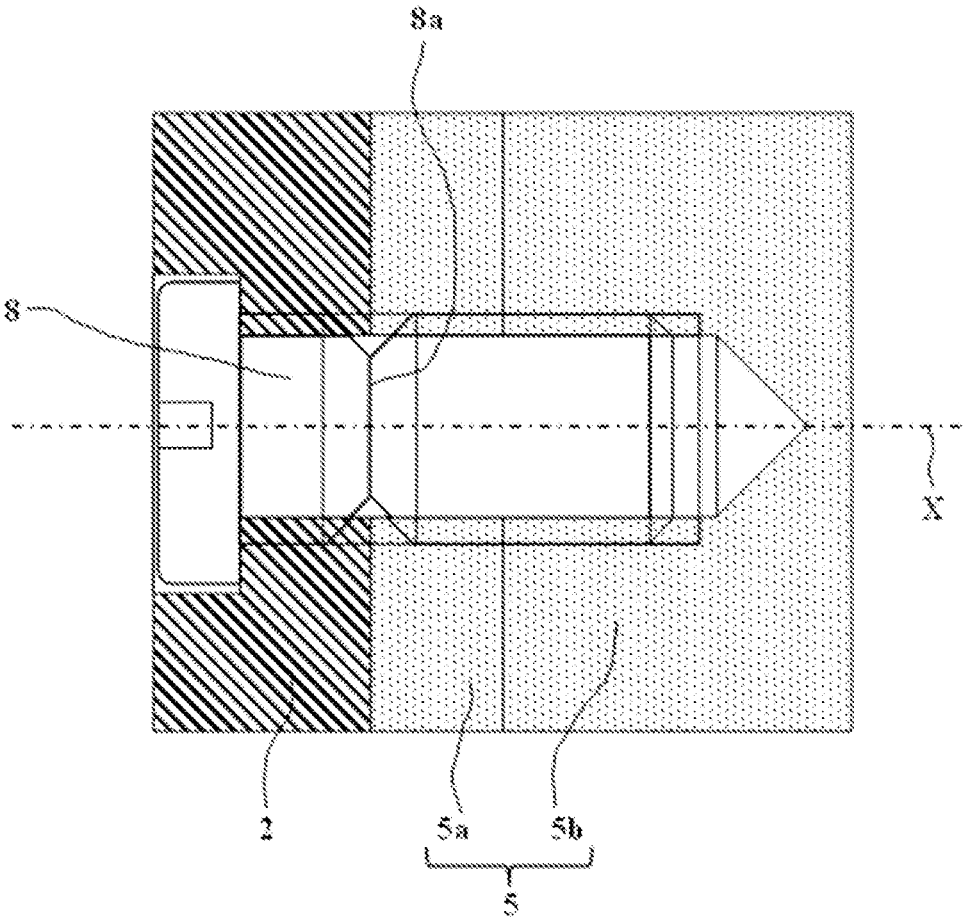

[Fig. 3]
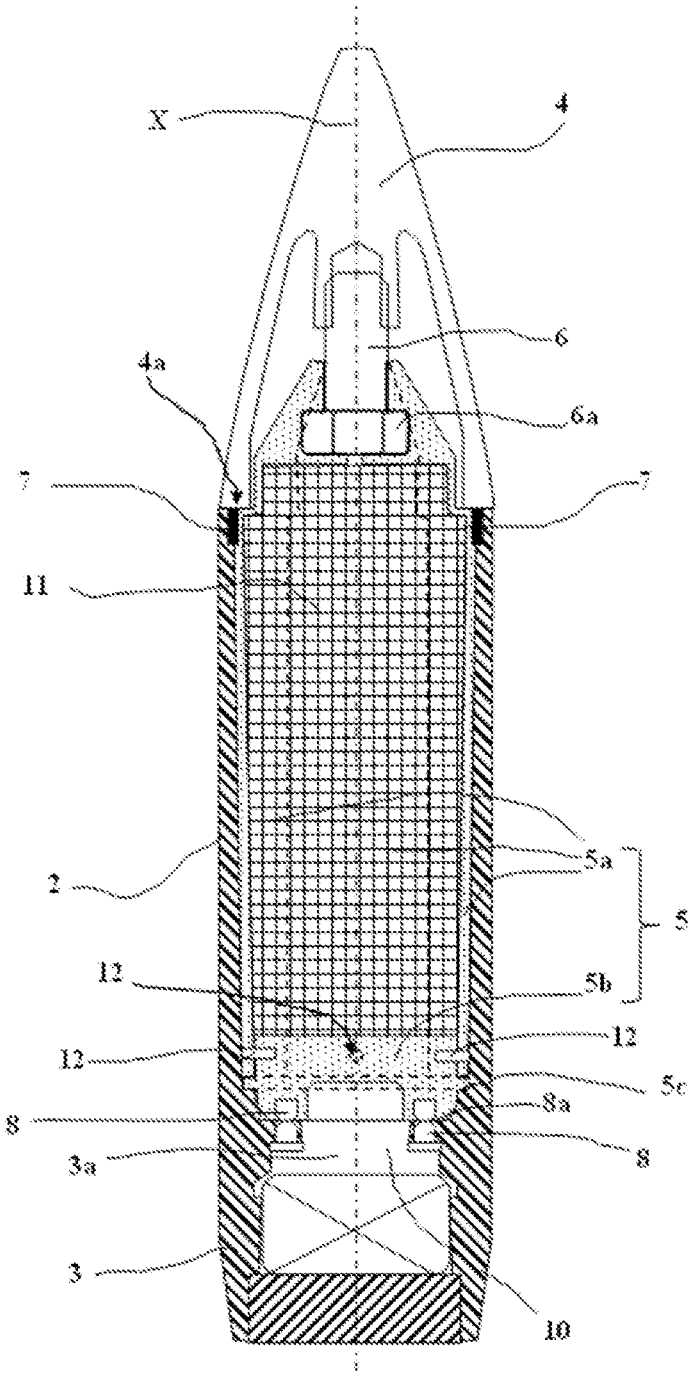

[Fig. 4]
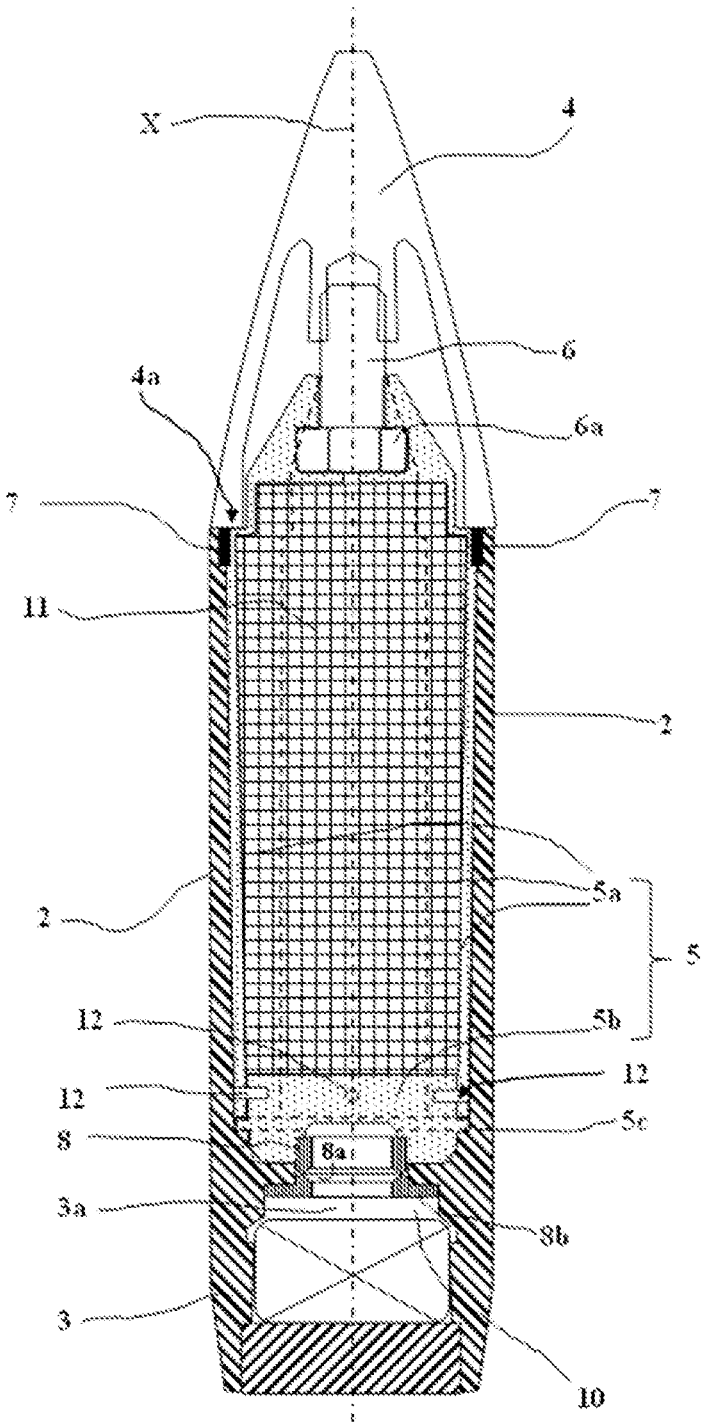

[Fig. 5]
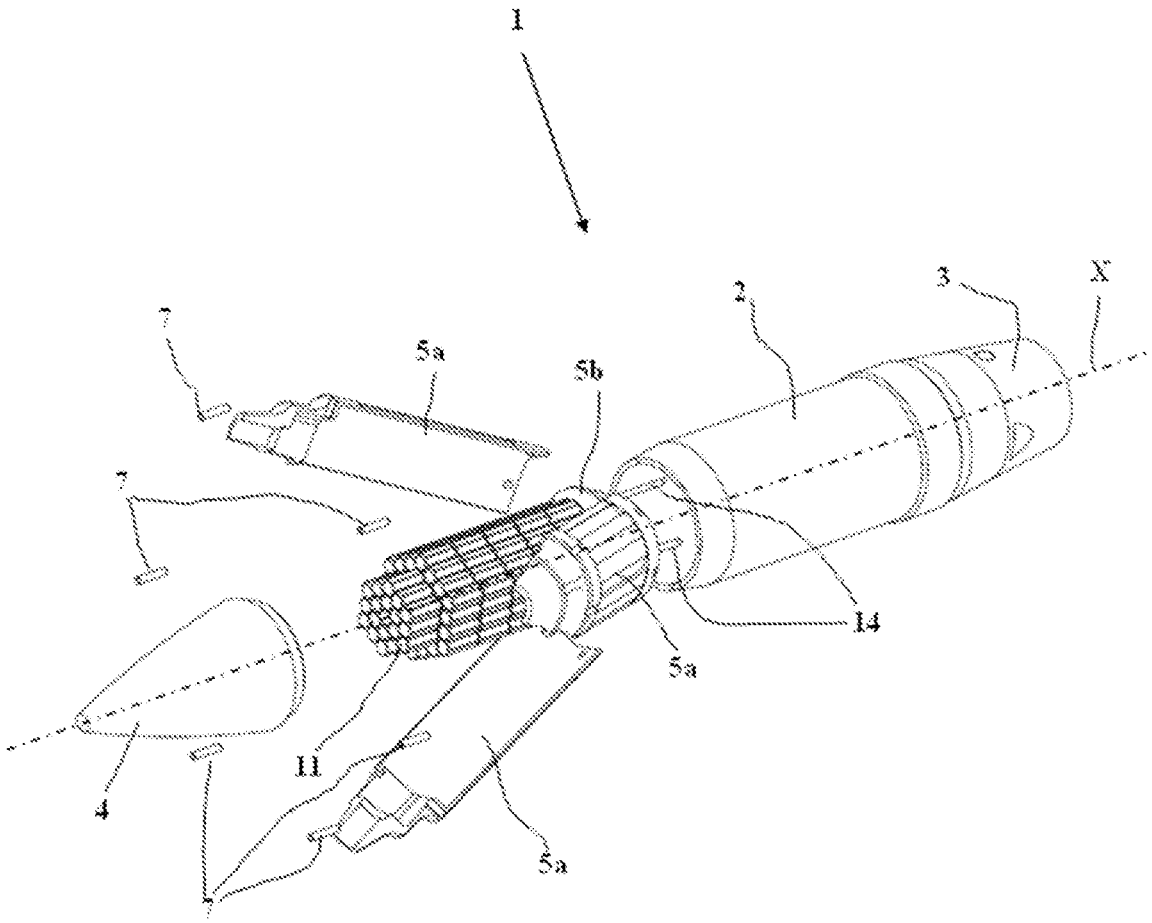

GYROSTABILIZED PROJECTILE

The technical field of the invention is that of gyrostabilized projectiles including a body containing a payload formed of a set of sub-projectiles that can be dispersed on trajectory by a pyrotechnic charge, and in particular that of medium-caliber projectiles (caliber between 20 mm and 70 mm) used in the context of anti-aircraft defense.

Patent EP2,578,987 discloses a gyrostabilized projectile including a body containing a cup filled with a set of sub-projectiles. The cup is expelled on trajectory, together with the sub-projectiles, by the action of a piston pushed by a pyrotechnic charge secured to a base at a rear part of the body. The body carries at its front part a ballistic ogive, which closes the cup. The ogive is connected to the body of the projectile at its periphery by a fragile connection, calibrated to break, and capable of breaking when the piston pushes the cup against the ogive as the sub-projectiles are expulsed.

Such a connection between the projectile body and the ogive is not satisfactory because it is located at a place on the projectile that is heavily loaded by radial impacts when the projectile is rammed in a gun, in particular at a so-called forcing cone in certain guns, said cone being for wedging the projectile before it is fired.

The stresses applied to the fragile connection between the ogive and the body can result in the breaking of the projectile, which can also damage the gun during firing, or simply so weaken the fragile connection that during the operation of the pyrotechnic charge it will not provide a resistance sufficient to achieve the correct pressure level for optimal ejection of the cup and the sub-projectiles.

The invention therefore proposes to solve a problem of the strength of the connection between an ogive and a projectile body ejecting a payload by pyrotechnic action.

The invention thus relates to a gyrostabilized projectile including a hollow body carrying a payload formed of a set of inert sub-projectiles that can be dispersed on trajectory and are contained in a cup that carries a piston closing one of its ends, the body being provided at its rear part with a base housing a pyrotechnic charge separated from the sub-projectiles by the piston, which can translate with respect to the projectile body so as to push the cup and the sub-projectiles axially out of the body, the single cup being substantially cylindrical and of a diameter corresponding to that of a cylindrical bore inside the body, the cup being formed by the assembly of at least two sectors, independent of each other and joined along their edges parallel to the longitudinal axis of the projectile, the projectile being characterized in that the piston is secured to the sectors when they are contained in the body and in that the cup is secured to the body by a weakened connecting means that is dimensioned to break under the force of the piston pushed by the gases generated by the pyrotechnic charge, an ogive being secured to the cup by means of a securing means that is coaxial with the longitudinal axis of the projectile and locked by the sectors of the cup.

Advantageously, the weakened connecting means may include screws connecting the projectile body and the piston, said screws having a section calibrated to break.

In another embodiment, the screws may be oriented radially to the longitudinal axis of the projectile.

Advantageously, each screw may also pass through a sector to connect it to the piston.

In another embodiment, the screws may be oriented parallel to the longitudinal axis of the projectile.

In another embodiment, the weakened connecting means may include a socket screwed into a bore in the rear face of the piston, the socket including a shoulder arranged so that a portion of the body is clamped between the shoulder and the rear face of the piston, thereby securing the cup to the body, the socket including a weakened zone calibrated for tensile failure.

In one particular embodiment, the means for securing the ogive to the cup may include a screw with a polygonal head, the front ends of the sectors of the cup being joined together around the polygonal head so as to form an embedded connection with the latter when the cup is in the body of the projectile, the separation of the sectors releasing the head.

Advantageously, the ogive may be screwed onto the screw and have its rim bearing on the body of the projectile.

According to a further feature of the invention, the projectile may include at least one key engaged in a correspondingly shaped housing located between each sector of the cup and the body of the projectile, so as to connect said sector of the cup and the body for rotation about the longitudinal axis of the projectile without hindering ejection of the cup from the body.

The invention will be better understood from the following description, which is made in the light of the annexed drawings in which:

FIG. 1 shows a cross-sectional view of a projectile according to a first embodiment of the invention.

FIG. 2 shows a detailed cross-sectional view of a projectile according to the first embodiment of the invention.

FIG. 3 shows a cross-sectional view of a projectile according to a second embodiment of the invention.

FIG. 4 shows a cross-sectional view of a projectile according to a third embodiment of the invention.

FIG. 5 shows a three-quarter view of a projectile according to the invention, during operation on trajectory.

According to FIG. 1, a medium-caliber projectile 1 (caliber between 20 mm and 70 mm) includes a hollow body 2 provided with a base 3 at its rear part. The front part of the body 2 is closed by a ballistic ogive 4. The hollow body 2 includes a substantially cylindrical cavity 2*a* opening out at the front of the body 2 and said cavity contains a correspondingly shaped cup 5.

The cup 5 is filled with inert sub-projectiles 11 forming a payload that can be dispersed on trajectory as will be discussed below.

The cup 5 includes sectors 5*a* that are independent of each other and joined along their edges parallel to the longitudinal axis X of the projectile 1. There are three sectors here.

The rear end of the cup 5 carries a piston 5*b* that closes its rear part. On the front part of the cup 5, the sectors 5*a* are joined together around a polygonal head 6*a* of a screw 6, coaxial with the projectile 1, so as to form an embedded connection of the screw 6 relative to the cup 5.

The screw 6 forms a means 6 for securing the cup 5 to the ogive 4. The threaded part of the screw 6 makes it possible to screw the ogive 4 until its rim 4*a* comes bearing against the front edge of the body 2.

Between each sector 5*a* of the cup 5 and the body 2 of the projectile 1, at least one key 7 is engaged in a correspondingly shaped housing 14 (the body 2 and the sector 5*a* in question sharing the housing). The keys 7 make it possible to connect the cup 5 and the body 2 for rotation about the longitudinal axis X of the projectile 1. There are two keys 7 per sector 5*a* here.

As can be seen in FIG. 5, the housing 14 for each key 7 is oriented parallel to the longitudinal axis X of the projectile 1 so as not to hinder the sliding ejection of the cup 5 out of the body 2.

In the embodiment shown in FIG. 1, the cup 5 is secured to the body 2 by means of screws 8 arranged radially to the longitudinal axis X of the projectile. The screws 8 form a securing means and penetrate the body 2 and the piston 5*b* while passing through the sectors 5*a*, thus connecting each sector 5*a* to the piston 5*b*.

In this way, the ogive 4 is strongly attached to the body 2 by means of the cup 5, which transfers any impact stresses experienced by the ogive 4 towards the interior of the projectile, to areas where the connection with the body is less weak.

As detailed in FIG. 2, the screws 8 are weakened connecting means as they have a shear weakening zone 8*a* located at the junction between the cup 5 and the body 2, providing to the connecting means 8 a shearable nature that is not disrupted by radial impacts on the ogive 4 for example.

The weakening zone includes, for example, a section 8*a* calibrated so as to break following the reaching of a stress threshold, which is obtained by the thrust of the piston 5*b* to which the pressure of the gases generated by the initiation of a pyrotechnic charge 10 is applied, the charge being located behind the piston 5*b*, in a chamber 3*a* at the base 3 of the projectile 1.

It is to be noted that the piston 5*b* includes a shoulder 5*c* on which the rear ends of the sectors 5*a* bear, which enables it, once the screws 8 have been broken, to push the sectors 5*a*, the sub-projectiles 11 and the ogive 4 in front of the body 2 in the direction of the trajectory of the projectile 1, as shown in FIG. 5.

As soon as the sectors 5*a* are ejected from the body 2, since the projectile 1 is gyrostabilized, the sectors 5*a* undergo centrifugal forces tending to spread them radially, thereby releasing the screw head 6 and thus the ogive 4.

The sub-projectiles 11 are also released and spread out into the surrounding space by centrifugal forces in order to bring their kinetic effects to bear on a target not shown, said kinetic effects being due to the velocity of the projectile 1 plus the velocity of projection provided by the thrust of the piston 5*b*. For the sake of readability of FIG. 5, the sub-projectiles 11 are shown before they are dispersed.

According to a second embodiment shown in FIG. 3, the weakened connecting means 8 are still screws 8 but they are oriented parallel to the longitudinal axis X of the projectile 1 and connect a rear part of the body 2 to a rear face of the piston 5*b*.

The weakened connecting means will therefore be dimensioned to break as a result of a tensile stress produced by the pressure of the gases generated by the charge 10. The sectors 5*a* of cup 5 are secured to the piston by pins 12. The pins 12 are cylindrical and have no protuberance at their end, which allows the easy separation of the sectors 5*a* from the piston 5 once the cup 5 has been ejected from the body 2, as shown in FIG. 5. On the other hand, when the cup 5 is in the body 2, the sliding fit of the cup 5 relative to the body 2 prevents any separation of the sectors from the piston 5*b*. The result is thus a monolithic assembly which strongly connects the ogive 4 to the projectile body.

According to FIG. 4, the weakened connecting means 8 includes a socket 8 that is screwed into a bore in the rear face of the piston 5*b* and that has a shoulder arranged so that a part of the body 2 is clamped between the shoulder 8*b* and the rear face of the piston 5*b*, thereby securing the cup 5 to the body 2.

The socket 8 has a weakened area calibrated for tensile failure so that the cup 5 can be ejected once the threshold pressure in chamber 3*a* is reached.

The invention claimed is:

1. A gyrostabilized projectile including a hollow body carrying a payload formed of a set of sub-projectiles, wherein the sub-projectiles are inert and configured to be dispersed on a trajectory, the projectile including a single cup that contains the sub-projectiles and includes a piston closing one of the ends of the cup, a rear part of the body being provided with a base housing a pyrotechnic charge separated from the sub-projectiles by the piston, wherein the piston configured to translate with respect to the body so as to push the cup and the sub-projectiles axially out of the body, the cup being substantially cylindrical and of a diameter corresponding to that of a cylindrical bore inside the body, the cup being formed by assembly of at least two sectors, independent of each other and joined along edges thereof that are parallel to a longitudinal axis of the projectile, wherein the piston is secured to the sectors when the piston and the sectors are contained in the body and the cup is secured to the body by a weakened connecting means configured to break under a force applied by the piston when the piston is pushed by gases generated by the pyrotechnic charge, an ogive being secured to the cup with a securing means that is coaxial with the longitudinal axis of the projectile and locked by the sectors of the cup.

2. The projectile according to claim 1, wherein the weakened connecting means includes screws connecting the body and the piston, said screws having a section calibrated to break.

3. The projectile according to claim 2, wherein the screws are oriented radially to the longitudinal axis of the projectile.

4. The projectile according to claim 3, wherein each screw also passes through a sector to connect said sector to the piston.

5. The projectile according to claim 2, wherein the screws are oriented parallel to the longitudinal axis of the projectile.

6. The projectile according to claim 1, wherein the weakened connecting means includes a socket screwed into a bore in a rear face of the piston, the socket including a shoulder arranged so that a part of the body is clamped between the shoulder and the rear face of the piston, thereby securing the cup to the body, the socket including a weakened zone calibrated for tensile failure.

7. The projectile according to claim 1, wherein the securing means includes a screw with a polygonal head, front ends of the sectors of the cup being joined together around the polygonal head so as to form an embedded connection with the polygonal head when the cup is in the body, separation of the sectors releasing the head.

8. The projectile according to claim 7, wherein the ogive has a rim and is screwed onto the screw so as to have the rim bearing on the body.

9. The projectile according to claim 1, wherein the projectile includes at least one key engaged in a correspondingly shaped housing located between each sector of the cup and the body, so as to connect said sector of the cup and the body for rotation about the longitudinal axis of the projectile without hindering ejection of the cup from the body.

* * * * *